US005120058A

United States Patent [19]

Trudeau et al.

[11] Patent Number: 5,120,058

[45] Date of Patent: Jun. 9, 1992

[54] MULTIPLE PATH BALL RAMP FOR PINBALL GAMES

[75] Inventors: John Trudeau; Zofia Bil, both of Chicago, Ill.

[73] Assignee: Williams Electronics Games, Inc., Chicago, Ill.

[21] Appl. No.: 751,183

[22] Filed: Aug. 28, 1991

[51] Int. Cl.[5] ..... A63F 7/30

[52] U.S. Cl. ..... 773/121 R; 273/122 R; 273/127 R; 273/127 C; 273/119 R

[58] Field of Search ..... 273/118 R, 118 A, 119 R, 273/119 A, 121 R, 121 A, 122 R, 122 A, 123 R, 123 A, 124 R, 124 A, 125 R, 125 A, 127 R, 127 C

[56] References Cited

U.S. PATENT DOCUMENTS

| | | | |
|---|---|---|---|
| 2,782,037 | 2/1957 | Rovira | 273/122 R |
| 3,008,717 | 11/1961 | Duerksen | 273/122 A |
| 4,354,680 | 12/1982 | Kniec | 273/121 A |
| 4,606,545 | 8/1986 | Ritchie | 273/121 A |
| 4,861,037 | 8/1989 | Oursler | 273/121 A X |

FOREIGN PATENT DOCUMENTS

| | | | |
|---|---|---|---|
| 2213740 | 8/1989 | United Kingdom | 273/121 A |

*Primary Examiner*—William H. Grieb
*Assistant Examiner*—Raleigh W. Chiu
*Attorney, Agent, or Firm*—Rockey and Rifkin

[57] ABSTRACT

A dual-path ramp for pinball games is formed of a single plastic member and has a plurality of entrances from the game playfield and exits back onto the playfield. The geometry of sides of the ramp is such that the ball, as it travels adjacent to one of the sides, is directed into a plurality of patterned grooves in the bottom surface of the ramp, which, in turn, direct the path of the ball back to the sides in a criss-cross pattern. In a second embodiment, ball guides, rather than grooves, are used to cause the ball to follow one side or the other of the ramp instead of criss-crossing back and forth.

8 Claims, 3 Drawing Sheets

MULTIPLE PATH BALL RAMP FOR PINBALL GAMES

BACKGROUND OF THE INVENTION

The present invention relates generally to pinball games, and more particularly to a multiple path ramp playfield feature for pinball games.

Pinball games, as commonly known, consist of an inclined playfield and a plurality of play features arranged on the playfield. A player uses flippers or similar means to direct a pinball at playfield features such as drop targets, bumpers or rotating playfield sections in order to score points. Ramps are used to allow the ball to travel between different levels on the playfield or to provide a different route of ball travel. In short, ramps are used to increase player appeal and interest in pinball games. Even though a number of different types of ramps are currently in use in pinball games, the addition of novel features is desirable to attract the greatest possible number of players to a particular pinball game.

A ramp playfield feature that allows the ball to travel along one of at least two predetermined paths, each of which may deposit the ball on a different location on the playfield is desirable.

Accordingly, it is a general object of the invention to provide a ramp playfield feature that provides a novel visual effect for the purpose of attracting additional players to pinball machines so equipped.

It is a further object of the invention to provide such a ramp that provides a plurality of paths on which a ball may travel.

It is another object of the invention to provide such a ramp having a plurality of entrances from the playfield and exits thereonto.

It is yet another object of the invention to provide such a ramp that is easily installed and is of durable, low-cost construction.

These and other objects of the invention will become apparent to those skilled in the art when the following detailed description of the invention is read in conjunction with the accompanying drawings

SUMMARY OF THE INVENTION

The ramp of the present invention is a single molded plastic member having a plurality of entrances from and exits to the playfield. The geometry of the ramp is such that the ball, as it travels thereon follows a serpentine path. In a first embodiment, the ball rolls against only one of the sides at a time and is directed in a criss-cross path from side to side via a plurality of grooves in the bottom surface of the ramp. Thus, the ball may contact only one side of the ramp at a time. The specific path taken by the ball, as well as the location to which the ball is ultimately conveyed on the playfield, is determined by the entrance the ball takes onto the ramp.

In a second embodiment, ball guides, rather than grooves, are used to cause the ball to follow one side or the other of the ramp instead of criss-crossing back and forth.

DETAILED DESCRIPTION OF A PREFERRED EMBODIMENT

Figure 1:
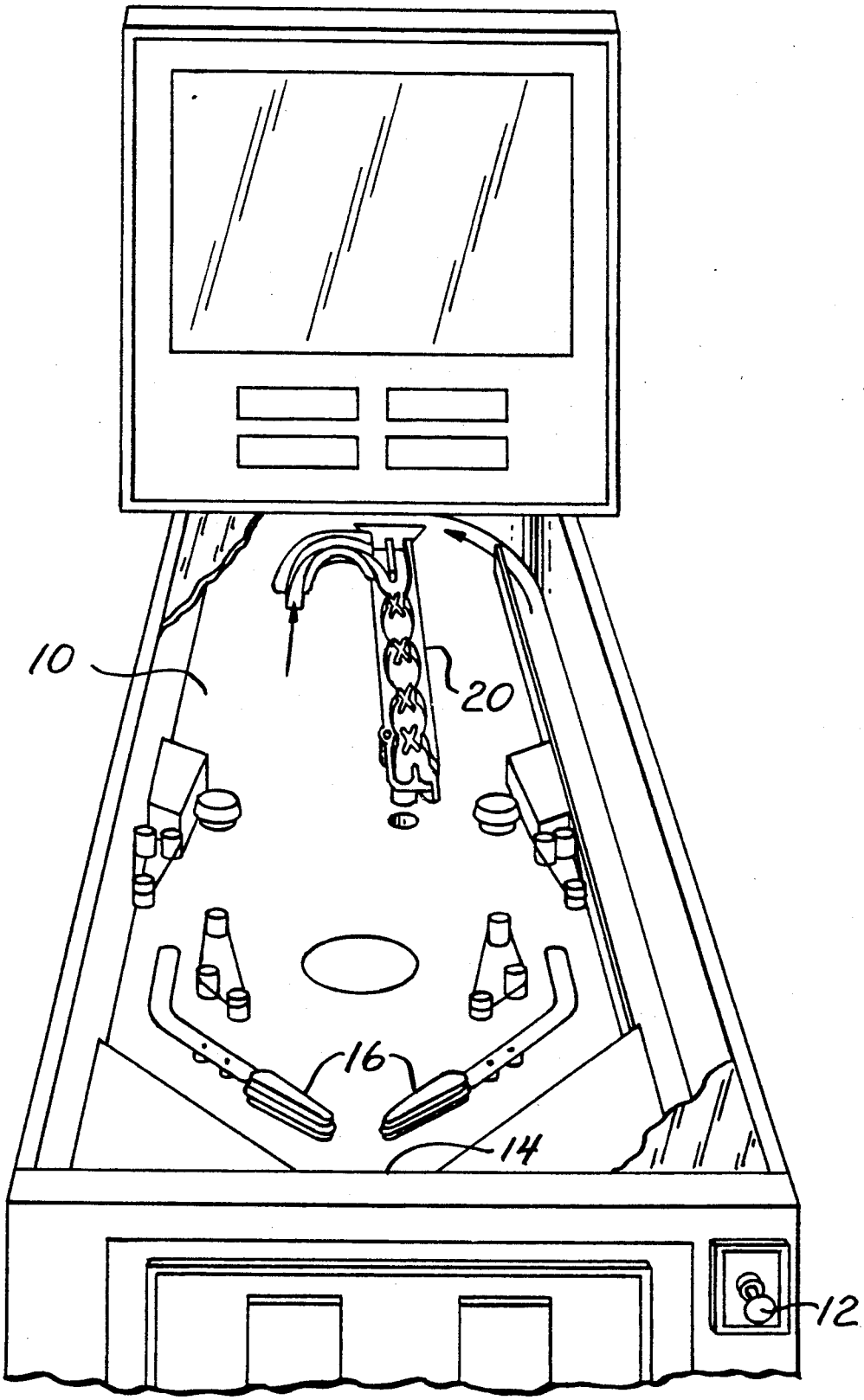
FIG. 1 is a perspective view of the upper portion of a pinball game having the ramp of the present invention disposed thereon.

Referring to the drawings, a pinball game playfield 10 is provided as shown, for example, in FIG. 1. The playfield 10 is typically inclined downwardly toward the bottom of the drawing to provide gravitational acceleration of the pinball toward the lower end of the playfield 10. The pinball is propelled onto the playfield 10 via a spring plunger 12. Thereafter, the ball is prevented from exiting an outhole 14 at the lower portion of the playfield by a pair of player-operated flippers 16. The flippers are operated by a pair of control buttons (not shown) located on the sides of the game cabinet. A multiple path ramp 20 constructed according to the teachings of the present invention is mounted on the playfield 10 in a downward-sloping orientation. The ball is motivated along the ramp by the force of gravity.

Figure 2:
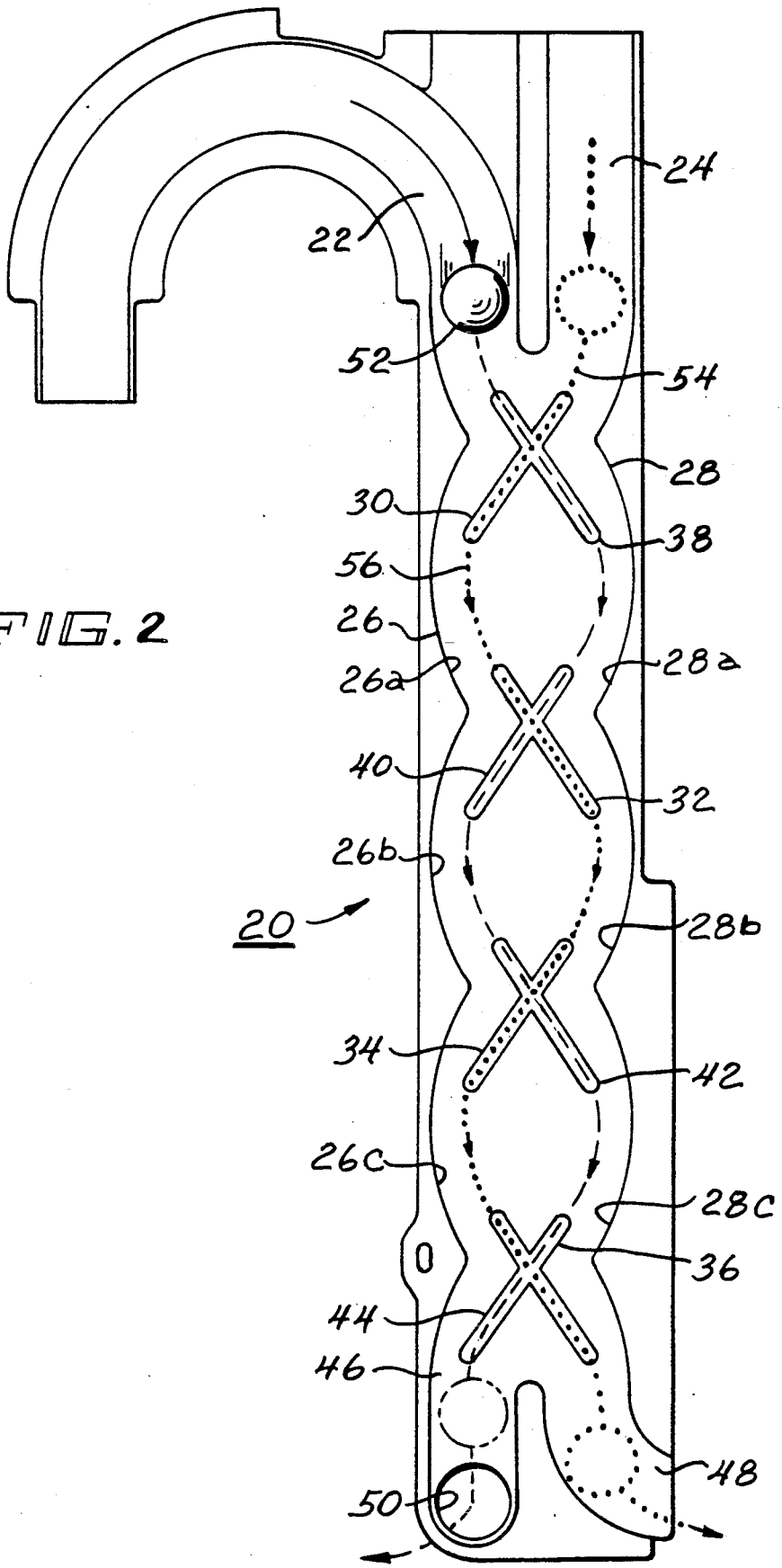
FIG. 2 is a plan view of a ramp according to a first embodiment of the present invention.

FIG. 2 shows the construction of a preferred embodiment of the present invention. The ramp 20 has a first entrance 22 and a second entrance 24. The ball may enter the ramp via either of these entrances from the playfield or other location via connecting ramps or by use of ball poppers, etc. The ramp is constructed so that the ball will follow a serpentine path. The sides 26, 28 of the ramp 20 are each constructed to form a series of linked arcs. A plurality of grooves 30–44 are formed in criss-crossing pairs on the bottom of the ramp 20. The grooves 30–44 are constructed to receive and guide the ball as it travels from side to side down the ramp, as will be described fully hereinafter. The grooves are approximately $\frac{1}{8}''$ deep and $\frac{1}{4}''$ wide for use with a standard diameter pinball. The ramp 20 also includes portions formed to define a first exit 46 and a second exit 48. As will be apparent to one of ordinary skill in the art, either exit may terminate in a drop hole 50, through which the ball may pass to a lower playfield, or by depositing the ball on the same playfield at a different location.

In operation, a pinball 52 enters the ramp 20 via the first entrance 22 and is engaged by the groove 38. Thereafter, the ball 52 generally follows the path shown by dashed line 54. When the ball comes to the end of the groove 38, the geometry of the side 28 is such that the ball travel continues along the path defined by a first arced portion **28*a* until it is engaged by the groove 40. The ball then crosses over and thereafter follows the arc formed by the ramp side 26*b* in the manner previously described, and continues through the groove 34 along the side portion 28*c*. Finally, the ball 52 follows the groove 44 into the first ramp exit 46 and drops back onto the playfield via the drop hole 50. If the ball enters the ramp 20 via the second entrance 24, it travels along the path shown by the dotted line 56 according to the principles previously described, finally exiting the ramp 20 via the second exit 48**.

Figure 3:
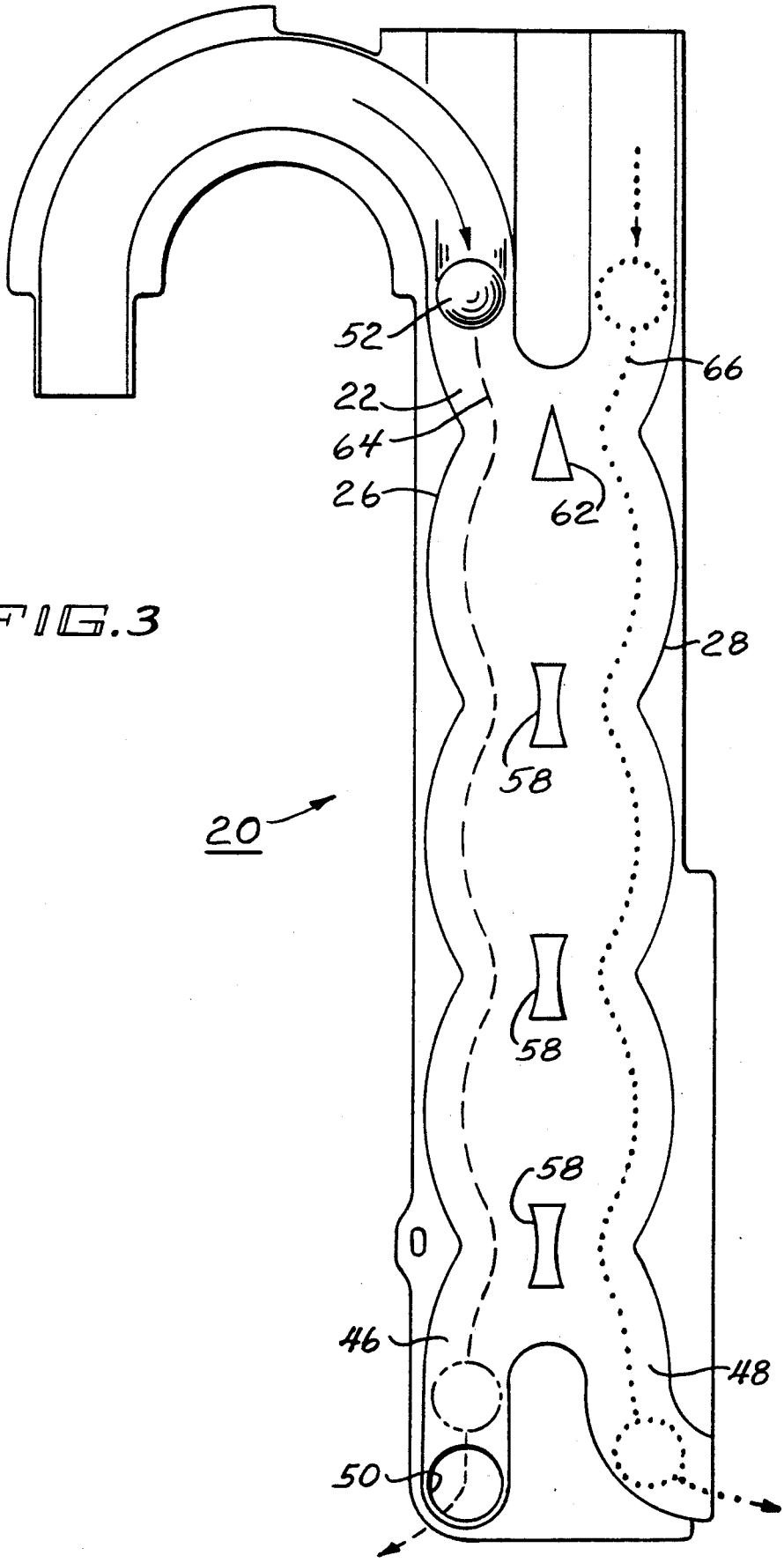
FIG. 3 is a plan view of a ramp according to a second embodiment of the present invention.

FIG. 3 shows a second embodiment of a ball ramp 20. In this embodiment, ball guides 58 are employed to ensure that the ball continues to travel along only one of the ramp sides 26, 28, depending on whether the ball 52 enters the ramp via the first entrance 22 or the second entrance 24. If the ball enters the first entrance 22, it will be urged toward the side 26 by a ball diverter 52. Thereafter, the path of the ball will continue along the dashed line 64. The ball guides 58, which are disposed adjacent to the ends of the arced portions defining the sides 26, 28, ensure that this path is followed until the ball exits the ramp via the first exit 46.

Similarly, if the ball enters the ramp 20 via the second entrance 24, it will follow the path shown by dotted line 66. The ball diverter 62 directs the ball along the side 28. The ball guides 58 ensure that the ball does not deviate from the path 66 until it exits via the second exit 48. It is within the contemplation of the invention to include attributes of both the first embodiment and the second embodiment in a given ramp. Such a configuration would provide multiple ball paths that criss-cross and travel alongside one of the sides of the ramp alternatively.

The present invention has been described with respect to certain embodiments and conditions, which are not meant to limit the invention. Those skilled in the art will understand that variations from the embodiments and conditions described herein may be made without departing from the invention as set forth in the appended claims.

What is claimed is:

1. In a pinball game having an inclined playfield and means for propelling a ball on said playfield, the improvement comprising a multiple path ball ramp mounted on said playfield in a downwardly sloping orientation, said ramp having a first side and a second side and being dimensioned so that said ball can contact only one of said sides at a time and having means for directing the path of said ball from said first side to said second and vice-versa at predetermined intervals.

2. The multiple path ball ramp according to claim 1 wherein said first side and said second side comprise a series of connected curvilinear portions.

3. The multiple path ball ramp according to claim 1 wherein said means for directing the path of said ball comprises a plurality of grooves disposed along the bottom of said ramp, said grooves being dimensioned to guide the ball from said first side to said second and vice-versa at predetermined intervals.

4. In a pinball game having an inclined playfield and means for propelling a ball on said playfield, the improvement comprising a multiple path ball ramp mounted on said playfield having a first side and a second side, said first side and said second side comprising a series of connected curvilinear portions, said ramp being dimensioned so that the ball can contact only one of said sides at a time, said ramp having means for directing the path of said ball along said first side or said second side.

5. The multiple path ball ramp of claim 4 wherein said means for directing the path of said ball comprises a plurality of curvilinear ball guides disposed one each adjacent to the beginning of each of said curvilinear portions.

6. In a pinball game having an inclined playfield and means for propelling a ball on said playfield, the improvement comprising a multiple path ball ramp mounted on said playfield in a downwardly sloping orientation, said ramp having a plurality of entrances thereto and exits therefrom, said ramp including means for causing the ball to travel in a serpentine path, the exit taken by the ball being determined by the entrance through which the ball enters the ramp.

7. The multiple path ball ramp according to claim 6 having a first side and said second side, each of which comprises a series of connected curvilinear portions.

8. The multiple path ball ramp according to claim 6 wherein said means for directing the path of said ball comprises a plurality of grooves disposed along the bottom of said ramp, said grooves being dimensioned to guide the ball from said first side to said second and vice-versa at predetermined intervals.

* * * * *